United States Patent [19]

Stoltze et al.

[11] 4,217,157

[45] Aug. 12, 1980

[54] METHOD OF FABRICATING FIBER-REINFORCED ARTICLES

[75] Inventors: Leon Stoltze, East Hartland, Conn.; Harry A. Nutter, Jr., Longmeadow; Robert F. Wilson, Springfield, both of Mass.

[73] Assignee: United Technologies Corporation, Hartford, Conn.

[21] Appl. No.: 962,498

[22] Filed: Nov. 20, 1978

[51] Int. Cl.[2] ..... B23P 17/00; B30B 15/06; B32B 31/00; B01D 47/00

[52] U.S. Cl. ..... 156/87; 156/286; 100/296; 29/423; 264/102; 425/85; 425/812

[58] Field of Search ..... 156/87, 96, 196, 286, 156/221, 123, 297; 100/93 P, 295, 296; 29/423, 419 R; 264/79, 102; 425/84, 85, 89, 812

[56] References Cited

U.S. PATENT DOCUMENTS

| | | | |
|---|---|---|---|
| 3,419,952 | 1/1969 | Carlson | 228/164 |
| 3,443,301 | 5/1969 | Basche | 228/178 |
| 3,606,667 | 9/1971 | Kreider | 29/423 |
| 3,674,109 | 7/1972 | Murase | 156/87 |
| 3,936,550 | 2/1976 | Carlson et al. | 156/155 |
| 4,065,338 | 12/1977 | Mirtain | 156/286 |
| 4,110,505 | 8/1978 | Prewo | 428/114 |
| 4,115,611 | 9/1978 | Stoltze et al. | 428/174 |

*Primary Examiner*—John T. Goolkasian
*Assistant Examiner*—L. Falasco
*Attorney, Agent, or Firm*—John D. Del Ponti

[57] ABSTRACT

A method for fabricating a filament reinforced metal matrix composite comprises bonding a plurality of filaments to a perforated metal foil with a fugitive binder, overlaying the filaments with a second perforated metal foil to form a stack, positioning the stack in a vacuum die, heating the stack in a vacuum to cause vaporization of the binder and evacuation of the vapors through the perforations in the foils and hot pressing to consolidate the stack.

5 Claims, 3 Drawing Figures

FIG.1
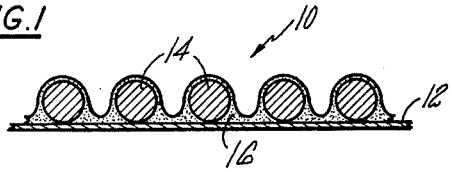
FIG.3
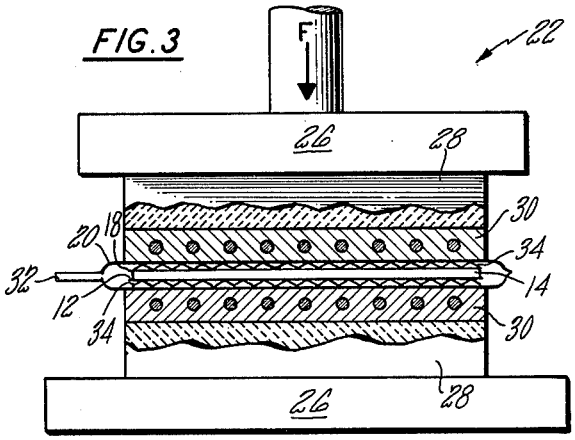
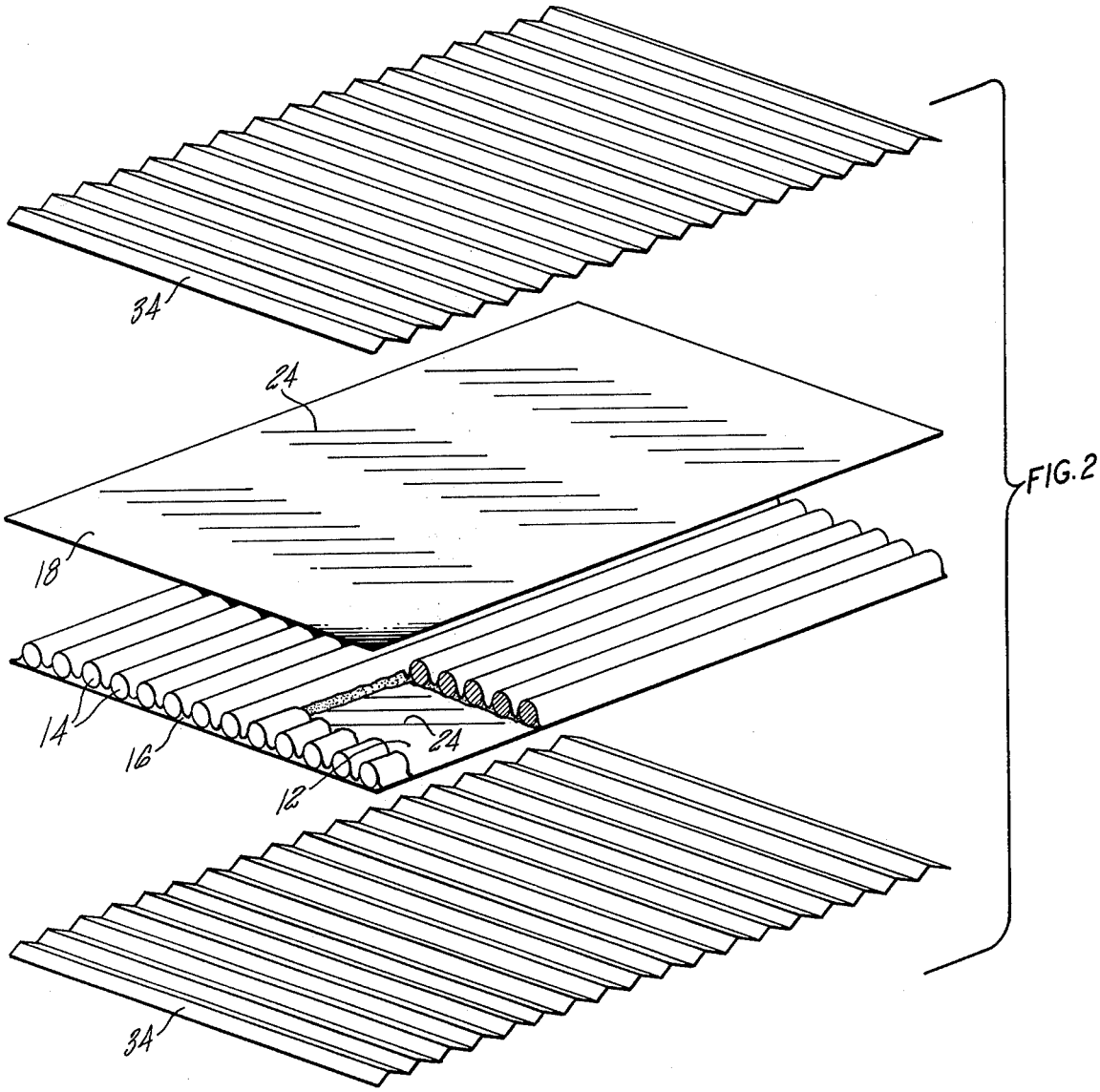
FIG.2

METHOD OF FABRICATING FIBER-REINFORCED ARTICLES

BACKGROUND OF THE INVENTION

1. Field of the Invention

The present invention relates to the production of fiber-reinforced metal matrix composite materials and, more particularly, to an improved process for fabricating such articles to provide a maximum fiber fill, as desired, and to impart reproducibility to fabrication from one article to the next.

2. Description of the Prior Art

The development of fiber-reinforced composite materials has received considerable attention in recent years. Progress has been made in the development of high strength, high quality fibers such as boron and silicon carbide-coated boron, for example, and their incorporation into a metal matrix such as aluminum, magnesium or titanium.

While the use of metal matrix fiber-reinforced composite tapes is well known to the manufacturer of composite materials, difficulties remain in the process of actually incorporating fibers into a fully densified metal matrix material to provide the desired end item. Much of the emphasis has centered on techniques for maintaining proper spacing and relative positioning between a multitude of the extremely small filaments prior to and during consolidation by hot press diffusion bonding. Additional focus has been on problems associated with fabricating large-sized composites. Some of these techniques have involved the preliminary fabrication of preforms, i.e., unconsolidated composites having the filaments in proper positional placement and in close association with metal matrix material.

In U.S. Pat. No. 3,419,952 to Carlson, there is disclosed a technique wherein grooves are provided in the surface of metal matrix sheets in order to position individual filaments prior to consolidation. In U.S. Pat. No. 3,443,301 to Basche et al, there is taught a method wherein individual filaments are provided with an overcoat of metal matrix material prior to hot pressing. In U.S. Pat. No. 3,606,667 to Kreider, metal matrix material is plasma sprayed onto filaments positioned on a backing foil to produce unconsolidated tapes which are subsequently diffusion bonded by hot pressing in a non-oxidizing atmosphere.

In U.S. Pat. No. 3,936,550 to Carlson et al, a fugitive binder (non-metallic adhesive bonding material which decomposes leaving substantially no residue upon heating at a temperature below the melting point of foil and filament) is used, in combination with foil deformation, to secure aligned filaments in place prior to consolidation.

In another practice using a fugitive binder, the binder is used to secure parallel filaments to a metal matrix foil sheet prior to stacking and consolidation. This technique typically utilizes a vacuum environment in the mold where subsequent hot pressing will occur to draw off (off-gas) the evaporated resin binder immediately prior to diffusion bonding of the preform. By virtue of the applied vacuum as well as the light pressure of flat caul plates at the ends of the stack, the filaments are held firmly between foils to thus maintain alinement as the resin is off-gassed. One of the problems inherent in this technique resides in the difficulty in achieving complete off-gassing. Since the gas being evacuated is, by virtue of physical constraints, required to travel along a lengthy path, i.e., between the foils in a direction parallel to and between adjacent filaments, complete removal of the resin binder gas has been problematical due to trapping or the like. In addition, this method presents problems with respect to the sequential hot step pressing of large composites since, as the fugitive binder is volatilized, the resulting gases are caused to travel through relatively cooler unconsolidated portions. This results in condensation and reformation into a new material which is no longer completely vaporizable at process conditions. The reliability of providing reproducible, uncontaminated, fully compacted composites by this prior fugitive binder technique has accordingly been low.

SUMMARY OF THE INVENTION

It is a general object of the present invention to obviate the foregoing problems by providing an improved method for consolidating fugitive binder filament foil preforms. It is a more specific object to provide means for assuring quick and complete outgassing of the fugitive binder during vacuum heating prior to hot press consolidation.

In accordance with an aspect of the present invention, the metal matrix foil sheets associated with the fugitive binder preform are provided with an array of openings located between filaments, preferably slits which bridge the gap between filaments, to provide immediate pathways for outgassing. In addition, the caul plates, which transfer pressure from the dies during hot pressing, are made thin and flexible and are provided with corrugations to extend the pathways during offgassing but to flatten during hot pressing. In a preferred embodiment, the axes of the corrugations are transverse to the axes of the filaments.

BRIEF DESCRIPTION OF THE DRAWINGS

An understanding of the invention will become more apparent to those skilled in the art by reference to the following detailed description when viewed in light of the accompanying drawings, wherein:

FIG. 1 is an enlarged sectional view through a fiber-foil preform;

FIG. 2 is an exploded perspective view of the preform, foil and caul plates as associated within the mold; and FIG. 3 is a sectional view through a vacuum mold.

DESCRIPTION OF THE PREFERRED EMBODIMENT

Referring first to FIG. 1, a fiber-foil preform 10 is shown comprising a foil 12 of metal such as aluminum, magnesium, titanium or alloys thereof to which a plurality of filaments 14 are affixed by means of a solvent evaporation-type adhesive 16, commonly referred to as a fugitive binder. Typically, the filaments are of the high modulus, high strength type such as boron, silicon carbide or silicon carbide-coated boron filaments. The fugitive binder may be of the organic solvent type, aqueous solution type or emulsion type and exemplary binders considered satisfactory are POLYSTYRENE, acrylic resin or Nicrobraze cement (sold by Wall Colmonoy Corp.).

Consolidation, which is the step of fully densifying the metal matrix material by bonding all of the metal matrix material together and eliminating voids, is accomplished in several steps. First, the preform 10 is combined with additional metal matrix material such as a second foil 18 in a stack. The stack is then positioned within a vacuum bag enclosure 20 within a mold 22. It is key to the present invention that both foils 12 and 18 are perforated, that is, provided with an array of tiny apertures or openings such as slits 24 to allow for immediate outgassing. While the size, shape and number of the openings is not critical, they must be large enough to provide rapid exhaust of the gases yet small enough to readily and completely close during consolidation. In this regard, it is preferred that the slits 24 are formed by local displacement of the metal without any loss or removal thereof in order to prevent any local nonuniformities of filament-matrix ratio. Thus, a typical slit width is approximately 0.001–0.003 inches.

The mold 22 is comprised of a pair of relatively movable pressure platens 26 each carrying an insulator 28 and an electrically heated die 30. Although not shown, a suitable vacuum pump is connected to vacuum bag 20 via exit port 32.

It is to be appreciated that although the present discussion is centered on the manipulation and consolidation of a stack which comprises only a single preform and foil, the described techniques are equally applicable where the stack includes a plurality of preforms as, for example, in the fabrication of a multilayer composite.

As shown in FIGS. 2 and 3, the stack is positioned between thin, flexible caul plates 34 within the vacuum bag 20. In order to effect complete off-gassing during evaporation of the fugituve binder, the caul plates 34 are corrugated, preferably with the axes of the corrugations running perpendicular to the axes of the filaments 14. The caul plates may preferably be fabricated of a metal such as stainless steel or Inconel at a thickness of 0.020–0.030 inches so as to be stiff enough to retain their corrugated shape under the vacuum conditions present during resin binder evaporation but thin enough to flatten under the pressure conditions of consolidation. To prevent bonding to the composite during and after consolidation, the caul sheets are sprayed with a release material such as graphite spray sold under the trade name GDF.

As an example, uniformly spaced boron filaments having a diameter of 0.0056 inches may be unidirectionally positioned at 140 per inch and bonded to the upper surface of a 0.0015 inch foil sheet of 6061 aluminum by spraying a thin coating of polystyrene thereover. A second aluminum foil sheet is positioned over the preform to form a stack and the stack is sandwiched between stainless steel caul plates (sprayed with graphite release material) within a carbon steel C1040 vacuum bag within the mold. Each of the foil sheets is provided with an array of slits which are at 45° to the filament axes, are each 0.6 inch long and 0.002 inch wide and are spaced 2 inches apart along the filament axes. A vacuum of 50–100 microns is established and the stack is heated to 500° F.(260° C.) to initiate vaporization and removal of the fugitive polystyrene binder whereupon the vacuum will evidence some deterioration. Once the vacuum is reestablished at its original level, the temperature is increased in increments of 100° F.(38° C.) until 800° F.(427° C.) and complete removal of the binder is reached, the vacuum being reestablished before each temperature increase. The stack is then consolidated by hot pressing at 1010° F.(543° C.) for 30 minutes at 5000 psi to produce a fully densified, voidless monolayer type having 50% fiber volume.

What has been set forth above is intended primarily as exemplary to enable those skilled in the art in the practice of the invention and it should therefore be understood that, within the scope of the appended claims, the invention may be practiced in other ways than as specifically described.

What is new and therefore desired to be protected by Letters Patent of the United States is:

1. A method for fabricating a consolidated fiber-reinforced metal matrix composite article comprising:

bonding a plurality of spaced filaments to one surface of a first metal foil with a fugitive binder, said filaments having their axes parallel and said foil having a plurality of apertures opening to the spaces between said filaments;

overlaying said filaments with a second metal foil to form a stack, said second foil having a plurality of apertures opening to said spaces between said filaments;

holding said stack in a vacuum die between a pair of corrugated flexible plates;

establishing a vacuum and temperature in said die sufficient to evaporate said fugitive binder to a gas, said gas being evacuated through said apertures and said corrugations; and hot pressing said stack to flatten said plates and consolidate said stack.

2. The method of claim 1 wherein said corrugations have axes transverse to said filaments' axes.

3. The method of claim 1 wherein said openings are formed by local displacements of metal of said foil.

4. The method of claim 1 wherein said filaments are selected from the group consisting of boron, silicon carbide and silicon carbide-coated boron.

5. The method of claim 1 wherein said filaments are boron and said metal matrix is aluminum.

* * * * *